US011025022B2

(12) United States Patent
Kim

(10) Patent No.: US 11,025,022 B2
(45) Date of Patent: Jun. 1, 2021

(54) ADAPTER FOR CHANGING CONNECTOR PITCH AND METHOD FOR MANUFACTURING SAME

(71) Applicant: LG Chem, Ltd., Seoul (KR)

(72) Inventor: Jeong Wan Kim, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/629,673

(22) PCT Filed: Jan. 24, 2019

(86) PCT No.: PCT/KR2019/001016

§ 371 (c)(1),
(2) Date: Jan. 9, 2020

(87) PCT Pub. No.: WO2019/151711

PCT Pub. Date: Aug. 8, 2019

(65) Prior Publication Data

US 2020/0169051 A1 May 28, 2020

(30) Foreign Application Priority Data

Jan. 30, 2018 (KR) ..... 10-2018-0011173

(51) Int. Cl.
*H01R 27/02* (2006.01)
*H01R 31/06* (2006.01)
(Continued)

(52) U.S. Cl.
CPC ..... *H01R 31/06* (2013.01); *H01R 13/04* (2013.01); *H01R 13/50* (2013.01); *H01R 43/18* (2013.01); *H01R 43/20* (2013.01)

(58) Field of Classification Search
CPC ..... H01R 31/06; H01R 13/04; H01R 13/50; H01R 43/18; H01R 43/20
(Continued)

(56) References Cited

U.S. PATENT DOCUMENTS 4,560,226 A 12/1985 Dennis
6,331,118 B1 12/2001 Ono et al.
(Continued)

FOREIGN PATENT DOCUMENTS

CN 201708421 U 1/2011
CN 102035112 A 4/2011
(Continued)

OTHER PUBLICATIONS

International Search Report from Application No. PCT/KR2019/001016 dated May 10, 2019, 2 pages.
(Continued)

*Primary Examiner* — Khiem M Nguyen
(74) *Attorney, Agent, or Firm* — Lerner, David, Littenberg, Krumholz & Mentlik, LLP

(57) ABSTRACT

An adapter for changing pitch of a connector, and a method of manufacturing the same, in which a first pin part and a second pin part, which are electrically connected, are formed at both end portions of a housing forming an exterior appearance of an adapter, so that it is possible to remove a wire harness and the like, which occupies a large volume in existing adapters, and so that it is possible to miniaturize a product by forming an integrated adapter by using fewer components, and to innovatively reduce production costs compared to existing adapter products.

16 Claims, 2 Drawing Sheets

(51) Int. Cl.

| | |
|---|---|
| ***H01R 13/04*** | (2006.01) |
| ***H01R 13/50*** | (2006.01) |
| ***H01R 43/18*** | (2006.01) |
| ***H01R 43/20*** | (2006.01) |

(58) Field of Classification Search
USPC ..... 439/638–655
See application file for complete search history.

(56) References Cited

U.S. PATENT DOCUMENTS

| | | | |
|---|---|---|---|
| 7,931,476 | B2 | 4/2011 | Russell |
| 9,209,547 | B2 | 12/2015 | Lozano Villarreal et al. |
| 9,525,256 | B2 | 12/2016 | Laurx et al. |
| 2001/0018294 | A1 | 8/2001 | Kameyama |
| 2011/0076863 | A1 | 3/2011 | Yetter et al. |
| 2016/0036176 | A1 | 2/2016 | Kato et al. |

FOREIGN PATENT DOCUMENTS

| | | | |
|---|---|---|---|
| CN | 203351789 | U | 12/2013 |
| CN | 103490252 | A | 1/2014 |
| JP | S53123183 | U | 9/1978 |
| JP | S63205077 | A | 8/1988 |
| JP | H0547444 | A | 2/1993 |
| JP | H06333652 | A | 12/1994 |
| JP | H0992365 | A | 4/1997 |
| JP | 2000012177 | A | 1/2000 |
| JP | 2001244012 | A | 9/2001 |
| JP | 2006147209 | A | 6/2006 |
| JP | 2010192190 | A | 9/2010 |
| KR | 200405283 | Y1 | 1/2006 |
| KR | 20120069003 | A | 6/2012 |

OTHER PUBLICATIONS

Supplementary European Search Report for Application No. 19746644 completed on Jun. 15, 2020, 2 pages.
Chinese Search Report for Application No. 201980003499.2, dated Oct. 12, 2020, pp. 1-3.

[Figure 1]
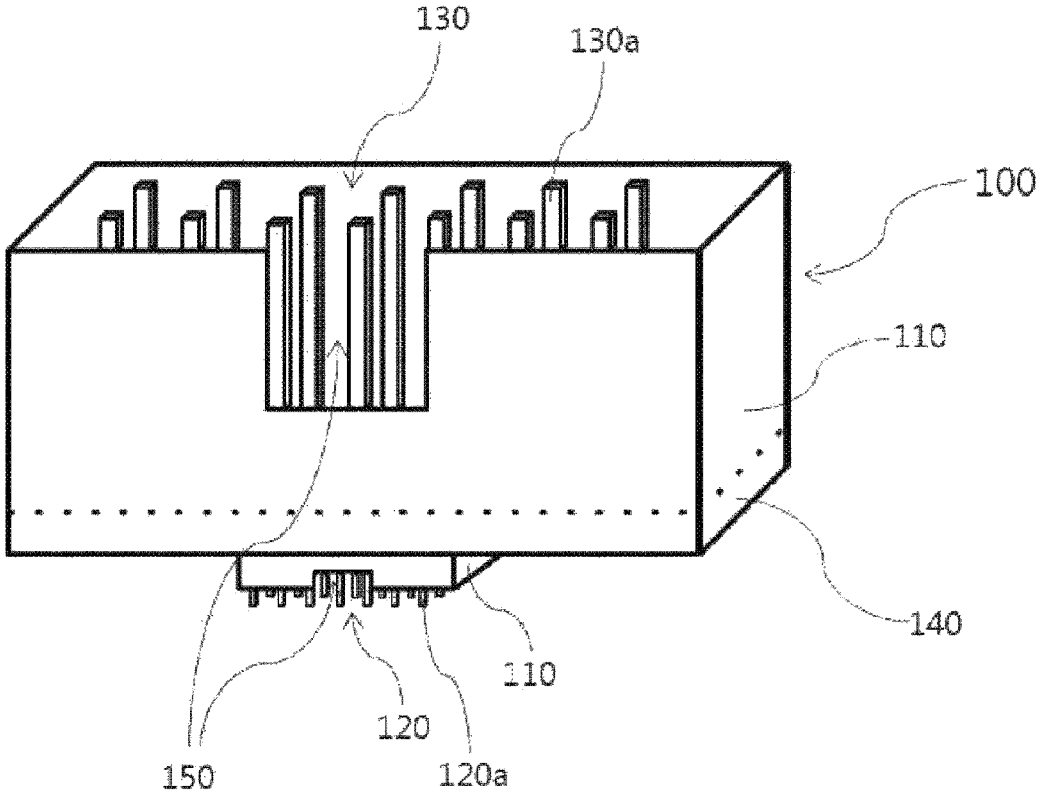

[Figure 2]
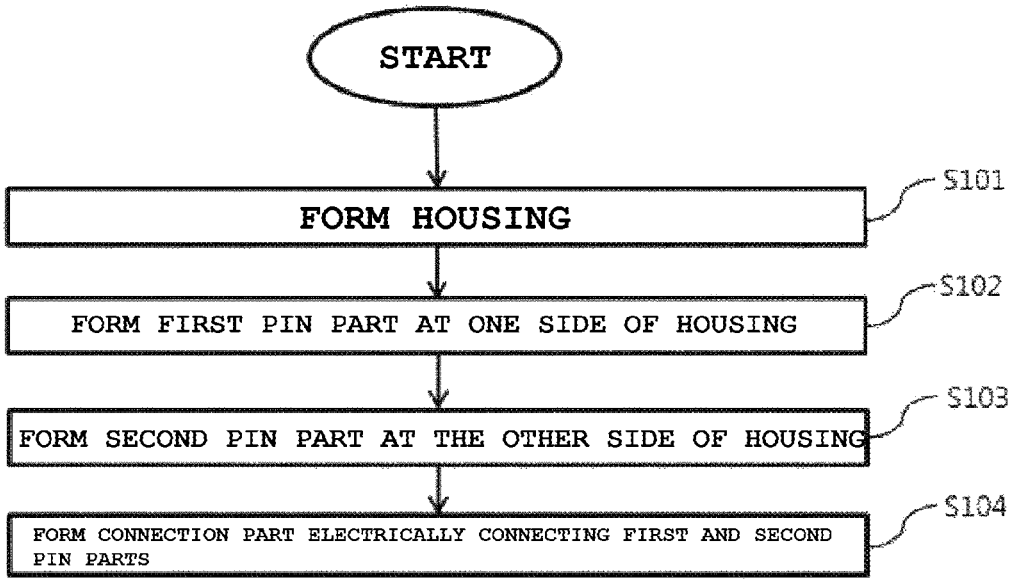

ADAPTER FOR CHANGING CONNECTOR PITCH AND METHOD FOR MANUFACTURING SAME

CROSS-REFERENCE TO RELATED APPLICATIONS

The present application is a national phase entry under 35 U.S.C. § 371 of International Application No. PCT/KR2019/001016 filed Jan. 24, 2019, published in Korean, which claims priority from Korean Patent Application No. 10-2018-0011173 filed Jan. 30, 2018, all of which are incorporated herein by reference.

TECHNICAL FIELD

The present invention relates to an adapter for changing a pitch of a connector, and a method of manufacturing the same, in which a first pin part and a second pin part, which are electrically connected, are formed at both end portions of a housing forming an exterior appearance of an adapter, so that it is possible to remove a wire harness and the like, which occupies a large volume in existing adapters, and so that it is possible to miniaturize a product by forming an integrated adapter by using fewer components, and to innovatively reduce production costs compared to existing adapter products.

BACKGROUND ART

A printed circuit board is a board, in which metal wires are thinly printed, and is provided so that various elements, such as a semiconductor, a condenser, a resistor, may be inserted into the printed circuit board. The printed circuit board serves to connect the elements and the like through the wires, and helps the disposition of the wires and the elements to be efficiently designed, thereby decreasing a size of the printed circuit board, and ultimately decreasing a size of an electronic device included in the printed circuit board.

A connector on the printed circuit board is a connection element, which is capable of connecting the printed circuit board with another device and the like. The connector on the printed circuit board is connected with another device in a development stage of the printed circuit board and serves to transfer an electric signal to the printed circuit board so that necessary software and the like may be uploaded or downloaded to the printed circuit board. A size of the connector on the printed circuit board also occupies a large portion of the entire size of the printed circuit board. When a size of the connector is decreased, it is helpful to miniaturize the printed circuit board.

However, when a smaller connector than an existing connector is used on the printed circuit board in order to miniaturize the printed circuit board, an adapter is used for connecting an access mechanism having the same pitch as that of the existing connector. The devices having connectors with different pitches may be electrically connected by using the adapter.

However, existing adapters are very expensive and include unnecessary components, such as a harness, so that there is a problem in that a volume of the adapter is increased and the like.

DISCLOSURE

Technical Problem

The present invention is conceived to solve the foregoing problems, and an object of the present invention is to provide an adapter for changing a pitch of a connector, in which a first pin part and a second pin part, which are electrically connected, are formed at both end portions of a housing forming an exterior appearance of an adapter, so that it is possible to remove a wire harness and the like, which occupies a large volume in existing adapters, and so that it is possible to miniaturize a product by forming an integrated adapter by using fewer components, and to innovatively reduce production costs compared to existing adapter products.

Technical Solution

In this respect, in order to solve the foregoing problem, the present inventors developed an adapter for changing a pitch of a connector, and a method of manufacturing the same, in which a first pin part and a second pin part, which are electrically connected, are formed at both end portions of a housing forming an exterior appearance of an adapter, so that it is possible to remove a wire harness and the like, which occupies a large volume in existing adapters, and so that it is possible to miniaturize a product by forming an integrated adapter by using fewer components, and to innovatively reduce production costs compared to existing adapter products.

An exemplary embodiment of the present invention provides an adapter for changing a pitch of a connector, the adapter including: a housing; a first pin part formed on one side of the housing; a second pin part formed on an opposing side of the housing; and an electrical connection configured to electrically connect the first and second pin parts.

In the exemplary embodiment, the first pin part may include a plurality of first pins, each of which corresponds to a first pitch, and the second pin part may include a plurality of second pins, each of which corresponds to a second pitch, and the electrical connection may be configured to electrically connect each of the first pins to a corresponding one of the second pins, respectively.

In the exemplary embodiment, the housing may be integrally formed so that a region, in which the first pin part is located, does not become separated from the first and second pin parts.

In the exemplary embodiment, the housing may be formed with a recess, which is provided so as to avoid interfering with a protruding portion protruding at one side of a connector connected with either the first pin part or the second pin part.

In the exemplary embodiment, the first pitch may be smaller than the second pitch.

In the exemplary embodiment, the second pitch may be between 1 mm to 2.54 mm.

In the exemplary embodiment, the first pitch may be 1.27 mm, and the second pitch may be 2.54 mm.

In the exemplary embodiment, the number of first pins may be equal to the number of second pins.

Another exemplary embodiment of the present invention provides a method of manufacturing an adapter for changing a pitch of a connector, the method including: forming a housing; forming a first pin part on one side of the housing; forming a second pin part on an opposing side of the housing; and forming an electrical connection, which electrically connects the first and second pin parts.

In the exemplary embodiment, the forming of the first pin part on the one side of the housing may include forming a plurality of first pins in the first pin part, the plurality of first pins having a first pitch and the forming of the second pin part on the opposing side of the housing may include forming a plurality of second pins in the second pin part, the plurality of second pins having a second pitch, the electrical connection electrically connecting each of the first pins to a corresponding one of the second pins, respectively.

In the exemplary embodiment, in the forming of the housing, the housing may be integrally formed so that the first pin part and the second pin part do not become separated.

In the exemplary embodiment, the forming of the housing may include forming a recess at one side of the housing so as to avoid interfering a protruding portion protruding from one side of a connector connected with either the first pin part or the second pin part.

In the exemplary embodiment, the first pitch may be smaller than the second pitch.

In the exemplary embodiment, the second pitch may be between 1 mm to 2.54 mm.

In the exemplary embodiment, the first pitch may be 1.27 mm, and the second pitch may be 2.54 mm.

In the exemplary embodiment, the number of first pins may be equal to the number of second pins.

Advantageous Effects

According to an aspect of the present invention, it is possible to provide an adapter for changing a pitch of a connector, and a method of manufacturing the same, in which a first pin part and a second pin part, which are electrically connected, are formed at both end portions of a housing forming an exterior appearance of an adapter, so that it is possible to remove a wire harness and the like, which occupies a large volume in existing adapters, and so that it is possible to miniaturize a product by forming an integrated adapter by using fewer components, and to innovatively reduce production costs compared to existing adapter products.

DESCRIPTION OF DRAWINGS

FIG. 1 is a diagram schematically illustrating a configuration of an adapter for changing a pitch of a connector according to an exemplary embodiment of the present invention.

FIG. 2 is a flowchart illustrating a method of manufacturing an adapter for changing a pitch of a connector in a series of sequence according to an exemplary embodiment of the present invention.

DETAILED DESCRIPTION

Hereinafter, an exemplary embodiment is presented for helping to understand the present invention. However, the exemplary embodiment below is simply provided for the easier understanding of the present invention, and the contents of the present invention are not limited by the exemplary embodiment.

FIG. 1 is a diagram schematically illustrating a configuration of an adapter 100 for changing a pitch of a connector according to an exemplary embodiment of the present invention.

Referring to FIG. 1, the adapter 100 for changing a pitch of a connector according to the exemplary embodiment of the present invention may generally include a housing 110, a first pin part 120, a second pin part 130, and a connection part 140. Further, the exemplary embodiment may additionally include a recess 150.

First, the adapter 100 for changing a pitch of a connector may serve to electrically connect connectors of two devices having different pitches. Accordingly, an electric signal may be transmitted between the two devices. Herein, the electric connection may mean the case where the connected elements or devices are allowed to transmit an electric signal. Further, the transmission of the electric signal may mean the case where necessary software and the like may be downloaded or uploaded to a device or a printed circuit board. Further, the transmission of the electric signal may mean the case where it is possible to determine a defect of an element and the like mounted on a printed circuit board, whether the element and the like are properly mounted on the printed circuit, whether a pattern is accurately printed on the printed circuit board, and the like. The printed circuit board may be a printed circuit board applied to a field of a battery management system of a vehicle.

The adapter 100 for changing a pitch of a connector may be integrally formed with the housing 110, the first pin part 120, the second pint part 130, and the connection part 140, which is to be described below. Further, the adapter 100 for changing a pitch of a connector may additionally include the recess 150. The integrated form may mean the form of a single mass.

The housing 110 may serve to make a general form of the adapter 100 for changing a pitch of a connector. Further, the housing 110 may serve to provide a space for an insertion or an accommodation of a connector according to a pitch of each of the first pin part 120 and the second pin part 130, which will be described below. Further, the housing 110 may serve to protect pins of the first pin part 120 and the second pin part 130. The protection of the pins may mean the physical protection of the pins from being bent or damaged due to external reasons. The housing 110 may be integrally formed, in which a region, in which the first pin part 120 is located, does not become separated from the first pin part 120 and the second pin part 130. Further, the recess 150, which is provided so as to avoid interfering with a protruding portion protruding from one side of the connector connected with the first pin part 120 or the second pin part 130 and will be described below, may be formed at one side of the housing 110.

The first pin part 120 may be electrically connected with a connector, which may be inserted into or accommodated in the first pin part 120, and serve to transmit an electric signal to the second pin part 130 via the connection part 140, which will be described below. Through the connection, the first pin part 120 may transmit the electric signal to another device connected to the second pin part 130. Further, the first pin part 120 may be formed at one side of the housing 110. This may mean that when the first pin part 120 is located on one side surface, the second pin part 130, which will be described later, is located on a surface adjacent to the first pin part 120 or a facing surface facing the first pin part 120. A pin direction of the first pin part and a pin direction of the second pin part may be formed to head in the same straight direction. Further, the first pin part 120 may include first pins 120*a* having a first pitch. Through the pins of the adapter, an electric signal may be transmitted between two devices including connectors having different standards. Herein, a pitch may mean a distance of an interval when things having the same shape are repeatedly arranged at the same interval. For example, the pitch may mean a distance between adjacent sawteeth of a saw-toothed wheel or a distance between adjacent screw threads in a screw. Further, the pitch may mean a distance between adjacent holes of the connector, a distance between adjacent pins of the adapter, and the like.

The second pin part 130 may be electrically connected with a connector, which may be inserted into or accommodated in the second pin part 130, and serve to transmit an electric signal to the first pin part 120 via the connection part 140, which will be described below. Through the connection, the second pin part 130 may transmit an electric signal to another device connected with the first pin part 120. The second pin part 130 may include one or more second pins corresponding to a second pitch. Further, the second pin part 130 may be formed at the other side of the housing 110. Further, the second pin part 130 may include one or more second pins 130*a* corresponding to the second pitch. The first pitch of the first pin part 120 for connecting two connectors having different pitches may be smaller than the second pitch of the second pin part 130. For example, the second pitch of the second pin 130*a* according to the minimum pitch of the connector may correspond to a pitch of 1 mm to 2.54 mm. According to the exemplary embodiment, the first pitch may correspond to a pitch of 1.27 mm, and the second pitch may correspond to a pitch of 2.54 mm. The first and second pitches may be changed according to the minimum pitch of the connectors connected to the first and second pitches. The number of first pins 120*a* may be the same as the number of second pins 130*a*.

The connection part 140 may serve to electrically connect the first pin part 120 and the second pin part 130. Accordingly, an electric signal may be transmitted between a device including the connector with the first pitch connected with the first pin part and a device including the connector with the second pitch connected with the second pin part. In the connection part 140, the pins of the first pins 120*a* and the second pins 130*a* may be electrically connected to one another, respectively. The corresponding connection may mean that, for example, when it is assumed that in an adapter including 14 pins, in which seven pins each are serially arranged in two lines, a number of the pin located at the leftmost and top side of one side in a direction of looking down the pin from an upper side is number 1 and a number of the pin located at the rightmost and top side is number 7, a number of the pin located at the leftmost and top side of the other side of the adapter which is horizontally rotated by 180° is number 7 and a number of the pin located at the rightmost and top side is number 1, so that the pins having the same number at the one side and the other side are connected with each other.

The recess 150 may serve to help the adapter and the connector to be easily coupled when the connector and the adapter are combined. For example, the recess 150, which is provided so as to avoid interfering with a protruding portion protruding from one side of the connector connected with the first pin part 120 or the second pin part 130, may be formed at one side of the housing 100.

Next, a process of designing an adapter for changing a pitch of a connector will be described with reference to FIG. 2.

FIG. 2 is a flowchart illustrating a method of manufacturing an adapter for changing a pitch of a connector in a series of steps according to an exemplary embodiment of the present invention.

Referring to FIG. 2, first, a housing is formed (S101). The housing may make a general form of the adapter and serve to provide a space for an insertion or an accommodation of a connector according to a pitch of each of a first pin part and a second pin part. Further, in the forming of the housing, the housing may be integrally formed so that the first pin part and the second pin part are not and do not become separated, and a recess may be formed at one side of the housing so as to avoid interfering with a protruding portion protruding from one side of the connector connected with either the first pin part or the second pin part.

Next, the first pin part is formed at one side of the housing (S102), and the second pin part is formed at the other side of the housing (S103). The first pin part may include one or more first pins corresponding to a first pitch. Then, the second pin part may include one or more second pins corresponding to a second pitch. Herein, the first pitch may be smaller than the second pitch. For example, the second pitch of the second pin 130*a* may be between 1 mm to 2.54 mm. According to the exemplary embodiment, the first pitch may be 1.27 mm, and the second pitch may be 2.54 mm. The first and second pitches may be changed according to the minimum pitch of the connectors connected to the first and second pitches. Further, the number of first pins may be the same as the number of second pins.

After the operations S101 to S103, a connection part, which electrically connects the first pin part and the second pin part, is formed (S104). Accordingly, an electric signal may be transmitted between a device including the connector with the first pitch connected with the first pin part and a device including the connector with the second pitch connected with the second pin part.

In the forgoing, the present invention has been described with reference to the exemplary embodiment of the present invention, but those skilled in the art may appreciate that the present invention may be variously corrected and changed within the range without departing from the spirit and the area of the present invention described in the appending claims.

The invention claimed is:

1. An adapter for changing a pitch of a connector, the adapter comprising:

a housing;

a first pin part formed on one side of the housing;

a second pin part formed on an opposing side of the housing; and an electrical connection configured to electrically connect the first and second pin parts, wherein the first pin part includes a plurality of first pins, each of which corresponds to a first pitch, and the second pin part includes a plurality of second pins, each of which corresponds to a second pitch, wherein the electrical connection is configured to electrically connect each of the first pins to a corresponding one of the second pins, respectively, wherein the housing includes:

a first housing portion defining a first cavity inside of which the first pin part is formed, wherein the first cavity is open along a first edge of the adapter for connection of the first pin part to a first connector portion;

a second housing portion defining a second cavity inside of which the second pin part is formed, wherein the second cavity is open along a second edge of the adapter for connection of the second pin part to a second connector portion;

a middle housing portion, wherein the electrical connection is housed inside of the middle housing portion; and a first opening formed in the housing at the first edge of the adapter, wherein the first opening is provided so as to avoid the first housing portion interfering with a protruding portion protruding at a side of a the first connector portion.

2. The adapter of claim 1, wherein the housing is integrally formed so that a region, in which the first pin part is located, does not become separated from the first and second pin parts.

3. The adapter of claim 1, wherein the first pitch is smaller than the second pitch.

4. The adapter of claim 1, wherein the second pitch is between 1 mm to 2.54 mm.

5. The adapter of claim 3, wherein the first pitch is 1.27 mm, and the second pitch is 2.54 mm.

6. The adapter of claim 1, wherein a number of the plurality of first pins is equal to a number of the plurality of second pins.

7. A method of manufacturing an adapter for changing a pitch of a connector, the method comprising:

forming a housing;

forming a first pin part on one side of the housing;

forming a second pin part on an opposing side of the housing; and forming an electrical connection, which electrically connects the first and second pin parts, wherein the forming of the first pin part on the one side of the housing includes forming a plurality of first pins in the first pin part, the plurality of first pins having a first pitch, and the forming of the second pin part on the opposing side of the housing includes forming a plurality of second pins in the second pin part, the plurality of second pins having a second pitch, the electrical connection electrically connecting each of the first pins to a corresponding one of the second pins, respectively, wherein forming the housing comprises:

forming a first housing portion defining a first cavity inside of which the first pin part is formed, wherein the first cavity is open along a first edge of the adapter for connection of the first pin part to a first connector portion;

forming a second housing portion defining a second cavity inside of which the second pin part is formed, wherein the second cavity is open along a second edge of the adapter for connection of the second pin part to a second connector portion;

forming a middle housing portion between the first housing portion and the second housing portion;

housing the electrical connection inside of the middle housing portion; and forming a first opening in the housing at the first edge of the adapter, wherein the first opening is provided so as to avoid the first housing portion interfering with a protruding portion protruding at a side of a the first connector portion.

8. The method of claim 7, wherein forming the housing includes integrally forming the housing so that the first pin part and the second pin part do not become separated.

9. The method of claim 7, wherein the first pitch is smaller than the second pitch.

10. The method of claim 7, wherein the second pitch is between 1 mm to 2.54 mm.

11. The method of claim 9, wherein the first pitch is 1.27 mm, and the second pitch is 2.54 mm.

12. The method of claim 7, wherein forming a plurality of first pins includes forming a number of first pins that is equal to a number of second pins.

13. The adapter of claim 1, wherein the first pitch is greater than the second pitch.

14. The adapter of claim 1, wherein the housing further includes a second opening formed in the housing at the second edge of the adapter, wherein the second opening is provided so as to avoid the second housing portion interfering with a protruding portion protruding at a side of a the second connector portion, and wherein the first and second openings are aligned with one another along a circumference of the housing.

15. The method of claim 7, wherein the first pitch is greater than the second pitch.

16. The method of claim 7, wherein the forming the housing further comprises forming a second opening in the housing at the second edge of the adapter, wherein the second opening is provided so as to avoid the second housing portion interfering with a protruding portion protruding at a side of a the second connector portion, and wherein the first and second openings are formed in alignment with one another along a circumference of the housing.

* * * * *